US009113238B2

(12) United States Patent
Akino

(10) Patent No.: US 9,113,238 B2
(45) Date of Patent: Aug. 18, 2015

(54) UNIDIRECTIONAL MICROPHONE

(71) Applicant: KABUSHIKI KAISHA AUDIO-TECHNICA, Machida-shi, Tokyo (JP)

(72) Inventor: Hiroshi Akino, Machida (JP)

(73) Assignee: KABUSHIKI KAISHA AUDIO-TECHNICA, Machida-Shi, Tokyo (JP)

( * ) Notice: Subject to any disclaimer, the term of this patent is extended or adjusted under 35 U.S.C. 154(b) by 322 days.

(21) Appl. No.: 13/775,981

(22) Filed: Feb. 25, 2013

(65) Prior Publication Data

US 2013/0287223 A1 Oct. 31, 2013

(30) Foreign Application Priority Data

Apr. 26, 2012 (JP) ..... 2012-100586

(51) Int. Cl.
*H04R 3/00* (2006.01)

(52) U.S. Cl.
CPC . *H04R 3/00* (2013.01); *H04R 3/005* (2013.01)

(58) Field of Classification Search
CPC ..... H04R 3/00; H04R 3/005
USPC ..... 381/92, 174, 176, 313, 337, 346, 355, 381/356, 361, 369, 412, 91, 122, 359, 365; 348/376; 379/388, 433.03; 455/575.1; 704/233
See application file for complete search history.

(56) References Cited

U.S. PATENT DOCUMENTS

| | | | | |
|---|---|---|---|---|
| 4,258,235 | A * | 3/1981 | Watson | 381/174 |
| 4,757,546 | A * | 7/1988 | Akino | 381/357 |
| 4,850,016 | A * | 7/1989 | Groves et al. | 379/433.03 |
| 5,226,076 | A * | 7/1993 | Baumhauer et al. | 379/420.02 |
| 5,627,901 | A * | 5/1997 | Josephson et al. | 381/160 |
| 5,878,147 | A * | 3/1999 | Killion et al. | 381/313 |
| 5,970,159 | A * | 10/1999 | McIntosh | 381/365 |
| 6,148,089 | A * | 11/2000 | Akino | 381/356 |
| 6,885,751 | B2 * | 4/2005 | Pribyl | 381/174 |
| 7,050,597 | B2 * | 5/2006 | Akino | 381/356 |
| 7,260,236 | B2 * | 8/2007 | De Roo et al. | 381/356 |
| 7,471,802 | B2 * | 12/2008 | Akino et al. | 381/355 |
| 7,492,914 | B2 * | 2/2009 | Arvidsson | 381/92 |
| 7,558,397 | B2 * | 7/2009 | Akino | 381/369 |
| 7,609,843 | B2 * | 10/2009 | Hatano et al. | 381/356 |
| 7,616,260 | B2 * | 11/2009 | Kano et al. | 348/376 |
| 7,623,671 | B2 * | 11/2009 | Akino | 381/356 |
| 7,751,582 | B2 * | 7/2010 | Akino | 381/337 |
| 7,797,025 | B2 * | 9/2010 | Hawker et al. | 455/575.1 |
| 7,801,321 | B2 * | 9/2010 | Akino | 381/355 |

(Continued)

OTHER PUBLICATIONS

Mizoguchi, Akio, "1-4-5 Issues on miniaturization of DC biased directional condenser microphones," Proceedings of the Meeting, The Acoustical Society of Japan, Oct. 1969, p. 133-134.

(Continued)

*Primary Examiner* — Gerald Gauthier
(74) *Attorney, Agent, or Firm* — Manabu Kanesaka

(57) ABSTRACT

The present invention provides a unidirectional microphone by adding an output from an omnidirectional condenser microphone unit and an output from a bi-directional ribbon microphone unit together. A condenser microphone unit 10 and a ribbon microphone unit 20 are connected in series via a step-up transformer 30, and the respective sound signals from the microphone units 10 and 20 are added together and are output from a source S of an FET 14.

10 Claims, 1 Drawing Sheet

(56) References Cited

U.S. PATENT DOCUMENTS

| | | | | |
|---|---|---|---|---|
| 7,840,013 | B2 * | 11/2010 | Dedieu et al. | 381/92 |
| 7,848,535 | B2 * | 12/2010 | Akino | 381/356 |
| 7,881,486 | B1 * | 2/2011 | Killion et al. | 381/313 |
| 7,953,241 | B2 * | 5/2011 | Jorgensen et al. | 381/356 |
| 7,966,178 | B2 * | 6/2011 | Gustavsson | 704/233 |
| 8,031,899 | B2 * | 10/2011 | Akino | 381/361 |
| 8,194,895 | B2 * | 6/2012 | Akino | 381/174 |
| 8,433,090 | B1 * | 4/2013 | Cloud et al. | 381/412 |
| 8,588,451 | B2 * | 11/2013 | Matsunaga | 381/355 |
| 8,705,786 | B2 * | 4/2014 | Akino | 381/355 |
| 8,824,719 | B2 * | 9/2014 | Tanaka et al. | 381/355 |
| 8,848,950 | B2 * | 9/2014 | Shimura | 381/174 |
| 8,948,433 | B2 * | 2/2015 | Akino | 381/356 |
| 2009/0154753 | A1 * | 6/2009 | Akino | 381/355 |
| 2011/0013800 | A1 * | 1/2011 | Akino | 381/361 |
| 2012/0014542 | A1 * | 1/2012 | Akino | 381/174 |
| 2012/0263332 | A1 * | 10/2012 | Akino | 381/355 |
| 2013/0216084 | A1 * | 8/2013 | Akino et al. | 381/346 |
| 2013/0287223 | A1 * | 10/2013 | Akino | 381/92 |
| 2014/0376752 | A1 * | 12/2014 | Akino | 381/176 |

OTHER PUBLICATIONS

Olson, Harry F., "A History of High-Quality Studio Microphones," Journal of the Audio Engineering Society, Nov. 1, 1976, p. 219-228.

Yasuno, Yoshinobu et al., "1-7-1 On the unidirectionality of combined microphones," Proceedings of the Meeting, The Acoustical Society of Japan, Mar. 1982, p. 245-246.

* cited by examiner

UNIDIRECTIONAL MICROPHONE

CROSS-REFERENCE TO RELATED APPLICATION

The present application is based on, and claims priority from, Japanese Application Serial Number JP2012-100586, filed Apr. 26, 2012, the disclosure of which is hereby incorporated by reference herein in its entirety.

TECHNICAL FIELD

The present invention relates to a unidirectional microphone, and in particular to a unidirectional microphone composed of a combination of an omnidirectional microphone unit and a bi-directional microphone unit.

BACKGROUND ART

Outputs from an omnidirectional microphone unit and a bi-directional microphone unit can be added (combined) together to provide a unidirectional microphone (see "1-7-1 On the unidirectionality of combined microphones" co-written by Yoshinobu Yasuno, Michio Matsumoto, Hiroyuki Naono, and Mitsuhiro Katakura, Proceedings of the Meeting, The Acoustical Society of Japan, March 1982).

Examples of combinations include a combination of a stiffness controlled omnidirectional condenser unit and a resistance controlled bi-directional condenser unit and a combination of a resistance controlled omnidirectional ribbon (dynamic) unit and a mass controlled bi-directional ribbon (dynamic) unit (see a presented paper of the meeting of the Audio Engineering Society held in New York, Nov. 1, 1976, titled "A History of High-Quality Studio Microphones," Harry F. Olson in Journal of the Audio Engineering Society, FIGS. 14 to 16, pp. 233, and related descriptions).

Omnidirectional components of a condenser microphone are stiffness controlled, and accordingly the resonance frequency of diaphragm is set to the upper limit of the sound pickup range. On the other hand, bi-directional components are resistance controlled.

In a DC biased condenser microphone, the tension on a diaphragm thereof cannot excessively be increased because the diaphragm is subject to an electrostatic attraction force from the fixed pole side. For this reason, the lower range limit for a unidirectional condenser microphone depends on the tension on the diaphragm (see Akio Mizoguchi "1-4-5 Issues on miniaturization of DC biased directional condenser microphones," Proceedings of the Meeting, The Acoustical Society of Japan, October 1969).

Meanwhile, the type of control of a bi-directional ribbon microphone is mass control. Accordingly, the resonance frequency of the diaphragm is set to the lower limit of the sound pickup range. Since the diaphragm (metallic ribbon foil) of a ribbon microphone vibrates in a magnetic field, the electrostatic attraction force does not act on the diaphragm as would be in the case of a DC biased condenser microphone, which allows the use of a lower tension on the diaphragm.

To provide a unidirectional microphone by adding (combining) the respective outputs from omnidirectional and bi-directional microphone units together, therefore, a combination of an omnidirectional condenser microphone and a bi-directional ribbon microphone is desirable in that there are less restrictions in terms of frequency.

However, the output level of a ribbon microphone unit is lower than that of a condenser microphone unit. The problem, therefore, is that an output from a condenser microphone unit and an output from a ribbon microphone unit cannot simply be added together in an attempt to provide a unidirectional microphone by combining the respective sound signal outputs from the units.

Accordingly, an object of the invention is to provide a unidirectional microphone by adding an output from an omnidirectional condenser microphone unit and an output from a bi-directional ribbon microphone unit together.

SUMMARY OF THE INVENTION

To solve the above problem, the present invention provides a unidirectional microphone including: an omnidirectional condenser microphone unit that converts a change in an electrostatic capacity into a sound signal and outputs the signal through an impedance converter, the capacity being generated between a diaphragm and a fixed pole facing each other with a predetermined space therebetween; and a bi-directional ribbon microphone unit that has a ribbon foil vibratably disposed in a magnetic field, wherein the condenser microphone unit and the ribbon microphone unit are connected in series via a step-up transformer, and the respective sound signals from the microphone units are added together and are output from the impedance converter.

According to a preferred aspect of the invention, the fixed pole is connected to the impedance converter, and the ribbon microphone unit is connected to a primary winding of the step-up transformer while a secondary winding of the step-up transformer is connected to the diaphragm.

As a further aspect, the diaphragm may be connected to the impedance converter, and the ribbon microphone unit may be connected to the primary winding of the step-up transformer while the secondary winding of the step-up transformer may be connected to the fixed pole.

Further, an output level of the ribbon microphone unit is preferably boosted by the step-up transformer to substantially the same level of an output level of the condenser microphone unit.

According to the invention, an output from the bi-directional ribbon microphone unidirectional is boosted and added to an output from the omnidirectional condenser microphone unit. Since outputs from the two microphone units are added together, a unidirectional microphone composed of a combination of an omnidirectional condenser microphone unit and a bi-directional ribbon microphone unit is provided.

DETAILED DESCRIPTION

Embodiments of the present invention will now be described with reference to FIGS. 1 and 2, although the present invention is not limited to the embodiments.

Figure 1:
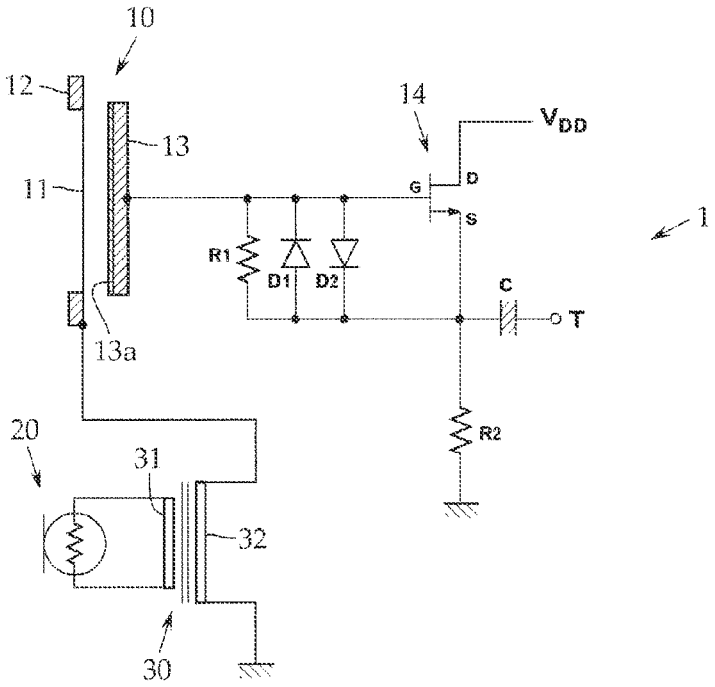
FIG. 1 is a schematic view illustrating a unidirectional microphone according to an embodiment of the present invention.

Referring first to FIG. 1, a unidirectional microphone 1 according to an embodiment includes an omnidirectional condenser microphone unit 10 that is a stiffness controlled unit suitable for being omnidirectional and a bi-directional ribbon microphone unit 20 that is a mass controlled unit suitable for being bi-directional.

The condenser microphone unit 10 is provided with an electroacoustic converter composed of a diaphragm 11, which is stretched over a diaphragm ring 12 with a predetermined tension, and a fixed pole 13. The diaphragm 11 and the fixed pole 13 are disposed to face each other with a spacer ring (not shown) interposed therebetween.

The diaphragm 11 may be a thin film of synthetic resin with a metallized film applied on one side. For example, the fixed pole 13 is an aluminum electrode plate and provided with an electret dielectric film 13*a* on the side facing the diaphragm 11.

While the condenser microphone unit 10 is a back electret type in the embodiment, the invention is not particularly limited to an electret type.

The condenser microphone unit 10 includes a field-effect transistor (FET) 14 that serves as an impedance converter. In the embodiment, the FET 14 is an FET that incorporates a bias, including two diodes D1 and D2 connected in parallel with each other between a gate G and a source S with their current flowable forward directions oriented opposite to each other and a high resistance element R1 connected in parallel with the diodes.

According to the embodiment, the fixed pole 13 is connected to the gate G of the FET 14 and a drive power supply $V_{DD}$ is connected to a drain D. The source S is connected to a ground through a resistor R2 for current detection and an output terminal T for sound signals is tapped from the source S through an electrolytic capacitor C for blocking a direct current.

The ribbon microphone unit 20 is a dynamic electroacoustic converter that has a ribbon foil composed of a metal, such as aluminum, vibratably disposed in a DC magnetic field formed by, for example, a pair of permanent magnets (not shown) spaced a predetermined distance apart.

Since the output level of the ribbon microphone unit 20 is lower than that of the condenser microphone unit 10, the ribbon microphone unit 20 cannot be electrically connected to the condenser microphone unit 10 as it is.

The present invention, therefore, uses a step-up transformer 30 for bringing the output level of the ribbon microphone unit 20 to substantially the same level of that of the condenser microphone unit 10. The ribbon microphone unit 20 is connected to the step-up transformer 30 on the primary side 31 of the transformer. One end of the transformer on the secondary side 32 is connected to the diaphragm 11 of the condenser microphone unit 10, and the other end on the secondary side 32 is connected to a ground.

Note that, while a high output level can be achieved by increasing the step-up ratio, the output impedance also increases accordingly. For this reason, since it is difficult to use the output as the microphone output as it is, the FET 14 that serves as an impedance converter is connected on the output side of the condenser microphone unit 10. This enables sound signals to be output at a low impedance.

As described above, according to the present invention, with the ribbon microphone unit 20 connected to the step-up transformer 30 on the primary side 31, the transformer is connected on the secondary side 32 to the diaphragm 11 of the condenser microphone unit 10 so that the ribbon microphone unit 20 and the condenser microphone unit 10 are connected in series.

In this way, output signals from two microphone units 10 and 20 are added together and sound signals can be output from the output terminal T connected to the source S of the FET 14 at a low output impedance.

Figure 2:
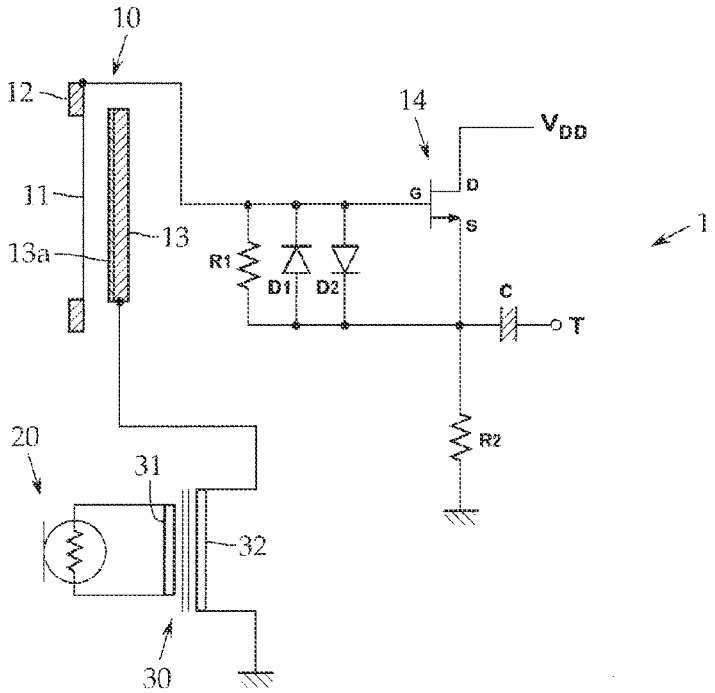
FIG. 2 is a schematic view illustrating a unidirectional microphone according to another embodiment of the present invention.

As an alternative embodiment, in the case where the diaphragm 11 is connected to the gate G of the FET 14 as shown in FIG. 2, the step-up transformer 30 may be connected to the fixed pole 13 on the secondary side 32 of the transformer. In this case, the phase of the output signal waveform is reversed and the directional axis is reversed by 180° with respect to the embodiment described above.

The invention claimed is:

1. A unidirectional microphone, comprising:

an omnidirectional condenser microphone unit converting a change in an electrostatic capacity into a sound signal and outputting the signal through an impedance converter, the condenser microphone unit including a diaphragm and a fixed pole facing each other with a predetermined space therebetween for generating the electrostatic capacity, the fixed pole being connected to the impedance converter;

a bi-directional ribbon microphone unit having a ribbon foil vibratably disposed in a magnetic field; and a step-up transformer having a primary winding connected to the ribbon microphone unit and a secondary winding connected to the diaphragm of the condenser microphone unit, to connect the condenser microphone unit and the ribbon microphone unit in series, for boosting an output level of the ribbon microphone unit to substantially a same level of an output level of the condenser microphone unit, wherein the respective sound signals from the microphone units are added together and are output from the impedance converter.

2. The unidirectional microphone according to claim 1, wherein the output level of the ribbon microphone unit is lower than that of the condenser microphone unit so that the step-up transformer boosts the output level of the ribbon microphone unit to substantially the same level of the output level of the condenser microphone unit.

3. The unidirectional microphone according to claim 2, wherein the fixed pole comprises an electret dielectric film on a side facing the diaphragm.

4. The unidirectional microphone according to claim 3, wherein the impedance converter includes a field-effect transistor including a source, a gate, two diodes connected in parallel to each other between the gate and the source, and a resistor connected in parallel to the two diodes.

5. The unidirectional microphone according to claim 4, wherein the condenser microphone unit sets a resonance frequency of the diaphragm to an upper limit of a sound pickup range, and the ribbon microphone unit sets the resonance frequency of the diaphragm to a lower limit of the sound pickup range.

6. A unidirectional microphone, comprising:

an omnidirectional condenser microphone unit converting a change in an electrostatic capacity into a sound signal and outputting the signal through an impedance converter, the condenser microphone unit having a diaphragm and a fixed pole facing each other with a predetermined space therebetween for generating the electrostatic capacity, the diaphragm being connected to the impedance converter:, a bi-directional ribbon microphone unit having a ribbon foil vibratably disposed in a magnetic field; and a step-up transformer having a primary winding connected to the ribbon microphone unit and a secondary winding connected to the fixed pole of the condenser microphone unit, to connect the condenser microphone unit and the ribbon microphone unit in series, for boosting an output level of the ribbon microphone unit to substantially a same level of an output level of the condenser microphone unit, wherein the respective sound signals from the microphone units are added together and are output from the impedance converter.

7. The unidirectional microphone according to claim 6, wherein the output level of the ribbon microphone unit is lower than that of the condenser microphone unit so that the step-up transformer boosts the output level of the ribbon microphone unit to substantially the same level of the output level of the condenser microphone unit.

8. The unidirectional microphone according to claim 7, wherein the fixed pole comprises an electret dielectric film on a side facing the diaphragm.

9. The unidirectional microphone according to claim 8, wherein the impedance converter includes a field-effect transistor including a source, a gate, two diodes connected in parallel to each other between the gate and the source, and a resistor connected in parallel to the two diodes.

10. The unidirectional microphone according to claim 9, wherein the condenser microphone unit sets a resonance frequency of the diaphragm to an upper limit of a sound pickup range, and the ribbon microphone unit sets the resonance frequency of the diaphragm to a lower limit of the sound pickup range.

* * * * *